US005255983A

United States Patent [19]

Parvin

[11] Patent Number: 5,255,983

[45] Date of Patent: Oct. 26, 1993

[54] SHOCK ABSORBING DISCONNECT LATCH FOR BALL BEARING SLIDES

[75] Inventor: Jackie D. Parvin, Pomona, Calif.

[73] Assignee: Accuride International, Inc., Santa Fe Springs, Calif.

[21] Appl. No.: 920,758

[22] Filed: Jul. 28, 1992

[51] Int. Cl.[5] ..... A47B 88/16

[52] U.S. Cl. ..... 384/21; 312/333

[58] Field of Search ..... 384/18, 14, 21; 312/333, 334.44, 334.46, 334.47

[56] References Cited

U.S. PATENT DOCUMENTS

| | | | |
|---|---|---|---|
| 3,801,166 | 4/1974 | York | 312/334.44 X |
| 4,423,914 | 1/1984 | Vander Ley | 312/333 |
| 4,473,262 | 9/1984 | Staye | 312/333 |
| 4,549,773 | 10/1985 | Papp et al. | 384/21 X |
| 4,560,212 | 12/1985 | Papp et al. | 384/18 |
| 4,872,734 | 10/1989 | Rechberg | 312/333 |
| 4,988,214 | 1/1991 | Clement | 312/333 X |
| 4,993,847 | 2/1991 | Hobbs | 384/21 |
| 4,998,828 | 3/1991 | Hobbs | 384/21 X |
| 5,002,402 | 3/1991 | Parvin | 384/21 |

*Primary Examiner*—Thomas R. Hannon

*Attorney, Agent, or Firm*—Christie, Parker & Hale

[57] ABSTRACT

A shock absorbing disconnect latch comprises a lever, a wall for limiting travel of a longitudinal channel, and at least one vertical slot in a downwardly sloping body to enable rearward flexing of the disconnect latch for removal of the longitudinal channel. The flexing of the disconnect latch causes the lever to move counterclockwise providing space for the longitudinal channel to be disengaged. The flexing of the disconnect latch permits easy removal of the longitudinal channel, together with reliable return of the lever. When the longitudinal channel is stopped by the wall of the disconnect latch, the shock energy is absorbed using the slot by deflection of the disconnect latch.

18 Claims, 3 Drawing Sheets

SHOCK ABSORBING DISCONNECT LATCH FOR BALL BEARING SLIDES

FIELD OF THE INVENTION

This invention generally relates to disconnect latches for ball bearing slides. The invention specifically relates to a disconnect latch capable of reliably stopping slide members, eliminating unintentional disconnection and absorbing the shock energy created from stoppage. Also, the latch permits easy removal of slide members.

BACKGROUND OF THE INVENTION

Drawers are often mounted within cabinets using ball bearing slides. Such slides permit easy access to the interior of the drawer. The slides maintain the drawer in a horizontal position regardless of how far the drawer is withdrawn from the cabinet.

Occasionally, a drawer must be removed from the cabinet, for example for repair or maintenance. Therefore, the slides preferably include means for allowing the drawer to be readily removed from the cabinet. However, the slide must also have means for preventing accidental or unintended disengagement of the drawer when the drawer is fully extended. Also, because the drawer slides must typically withstand many years of repetitive opening and closing, there is a need for drawer slides which continue to operate smoothly over extended periods of use. All drawer slides must endure severe industry performance testing. For example, one common test for drawer slides requires slide mechanisms to withstand both 15,000 two-inch travel cycles and five 80% travel cycles in response to a 15 pound pull while the drawer carries up to a 100 pound load.

Previous designs for drawer slides encountered many disadvantages in operation. Prior slides had a disconnect latch secured to one guide or member of the slide to prevent unintentional disengagement of another slide member. Removing drawers was previously accomplished by pushing down on an arm of the latch, thereby rotating the latch to pivot about a rivet or an extruded post encompassed by a rivet, providing space for the slide member to be disengaged.

A prior design for a drawer slide assembly with a pivoting disconnect latch is shown in FIG. 1. The slide member 10 has a longitudinal channel 14 comprising top and bottom slide retainers 12, 16. The pivoting style latch 20 is attached to the channel 14 using a rivet 42 in a counterbored ring 40.

As shown in FIG. 1*a*, on either side of the rivet 42 is an annular upwardly protruding extruded post 44. The rivet head extends over the tops of the extruded post 44; thus, the post 44 prevents the rivet head 43 from contacting the interior wall 41 of the counterbored right 40. One of ordinary skill in the art will recognize that the bottom of the rivet head 43 is tightly clamped against the top of the extruded post 44. This structure is intended to prevent the rivet head from bearing against the latch, which would prevent the latch from returning to its normal position after pivoting. Consequently, the dimensions of the depth and height of the extruded post 44 are critical to proper function of the prior art latch of FIG. 1. Even minute errors in these dimensions will cause problems in operation of the prior art latch.

One of ordinary skill in the art will understand that FIGS. 1 and 1*a* omit an intermediate slide member with guide block, ball bearings, and a second longitudinal channel, which are omitted for clarity. An operational slide would comprise an assembly of all the above.

The pivoting style latch 20 of FIG. 1 comprises a lever 22 formed unitarily with a counterbored ring 40 and an intermediate arm 28. When a user of the slide wishes to disconnect the slide, lever 22 is depressed using finger pressure. The lever and ring then pivot counterclockwise or clockwise depending on their orientation in the cabinet, about the extruded post 44 and rivet 42, when the lever 22 is depressed. The longitudinally proximal arm 24 moves counterclockwise, providing space for the inner longitudinal channel with guide block to clear the normally abutting face of the wall 26. Thus both the lever 22 and the arm 24 move counterclockwise towards the intermediate arm 28. Consequently the horizontal aperture 30 compresses or decreases in size when the lever 22 moves toward the intermediate arm 28. The depressed lever position 50 is shown in phantom indicating the position of the lever when depressed by finger pressure.

The pivoting of ring 40 about the extruded post 44 causes the latch to malfunction if the rivet head is secured too tightly over the extruded posts and bears against latch 20. Thus the pivoting style latch 20 may fail to return to its non-impacted position after the extended use which drawer slides are subjected to.

Prior latches also produced excessive noise in operation due to impact of a slide member on the latch and the inability of prior latches to absorb impact pressure. Limiting the travel of slide members using a stop is well understood by those skilled in the art as shown in Papp U.S. Pat. No. 4,560,212. Using a prior latch, when intermediate or outer slide members are stopped by the wall 26 of the latch of FIG. 1, the impact is noisy due to the rigid construction of the pivoting style latch. The FIG. 1 design does not have a means for absorbing the shock energy on the latch or rivet created when a slide member is stopped by the wall 26. In prior designs, all the load is transmitted throughout the latch which increases the risk of mechanical failure of the latch or guide block 46. In addition, sufficiently strong impact pressure on the wall 26 may cause the rivet 42 to be sheared off channel 14. The pivoting style design also requires precise parameters in the extruded post height, rivet clinch, and recess depth and diameter. Thus, manufacturing controls must insure only slight deviations in the dimensions of the recess, extruded post and rivet.

Consequently, prior designs for disconnect latches can be expensive and complex to manufacture. There is also a need for a drawer slide which promotes smooth, noise-free movement of the disconnect latch. Accomplishing this without complex manufacturing controls is advantageous. It would also be desirable that the latch function correctly even after years of repetitive opening and closing of the drawer.

SUMMARY OF THE INVENTION

The present invention provides a shock absorbing disconnect latch for a drawer slide comprising a wall or stop for limiting longitudinal travel of a slide member, a latch body unitarily formed with the wall and having at least one vertical slot which permits both flexing of the latch to enable disengagement of the slide member, and also absorption of the shock energy created when the slide member is stopped. A longitudinally elongated lever is formed unitarily with the latch body to enable flexing of the latch using downward pressure on the lever.

The disconnect latch of the invention eliminates the need for pivoting and instead flexes. When the latch is depressed to remove the drawer, or impacted by pressure of a slide member on the wall, the latch flexes under the load. This flexing design eliminates the need for critical dimensions of the pivoting components, so manufacturing control costs and complexity are lessened. The latch is injection molded as a single piece and has a non-rotating mounting hole which simplifies manufacturing.

The disconnect latch dissipates shock energy by deflecting in the same direction as the impact load. Once the impact energy has been absorbed, the disconnect latch returns to the original non-impacted position. This greatly reduces the transmitted peak load that must be absorbed by the disconnect latch. Thus the reliability of the latch is increased.

BRIEF DESCRIPTION OF THE DRAWINGS

Details of the invention are described below and will be more fully appreciated with reference to the accompanying drawings.

DETAILED DESCRIPTION

Figure 4:
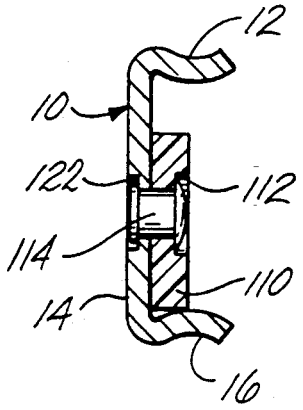
FIG. 4 shows a cross-sectional view of the latch taken on line 4—4 of FIG. 3.
Figure 5:
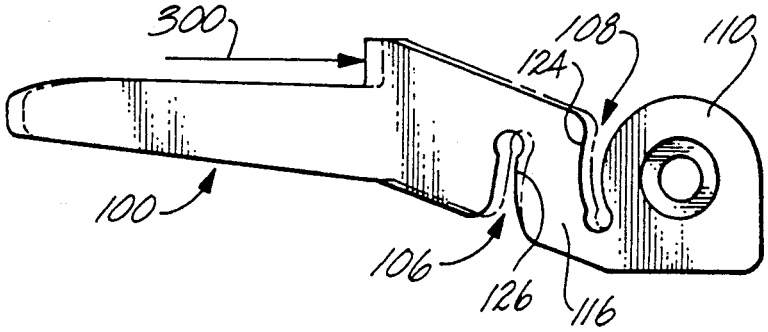
FIG. 5 shows a side view of the disconnect latch with a deflected position of the disconnect latch, under impact load, shown in phantom.
Figure 6:
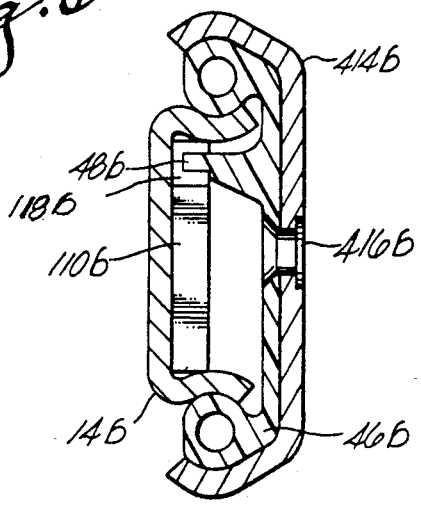
FIG. 6 shows a cross-section view of a latch of the invention attached to a slide member with a guide block interconnecting with another slide member.

The present invention, a shock absorbing disconnect latch 100, is shown in FIGS. 2 to 6. Like reference numbers in the figures identify similar parts. The latch in FIG. 6 is of opposite sense to that in FIGS. 2-5 (for use on the opposite side of a drawer). Since all the parts are similar, the reference numerals are the same, but include the letter "b".

The disconnect latch 100 preferably is secured to the longitudinal channel 14 of a drawer slide 10. The longitudinal channel 14 comprises two top and bottom slide retainers 12 and 16 spaced apart by any desired slide width. The width of the channel 14 is approximately equal to the width of the non-impacted disconnect latch 100.

The disconnect latch 100 comprises a lever 22 which extends horizontally parallel to the slide retainers 16 and 12. A stop or impact wall 104 is formed generally normal to the lever and is formed integrally with the lever. A rearwardly downwardly angled wall 118 joins the lever and wall to a bridge portion 116 and a rear ring 110. The ring 110 is generally circular and has a generally horizontal bottom edge 128; the ring is formed integrally with the stop and the lever. When the latch is mounted in the channel 14 in its normal position, the retainers 16 and 12 are adjacent to the tip 120 of wall 118 and edge 128 of the ring 110.

Figure 1:
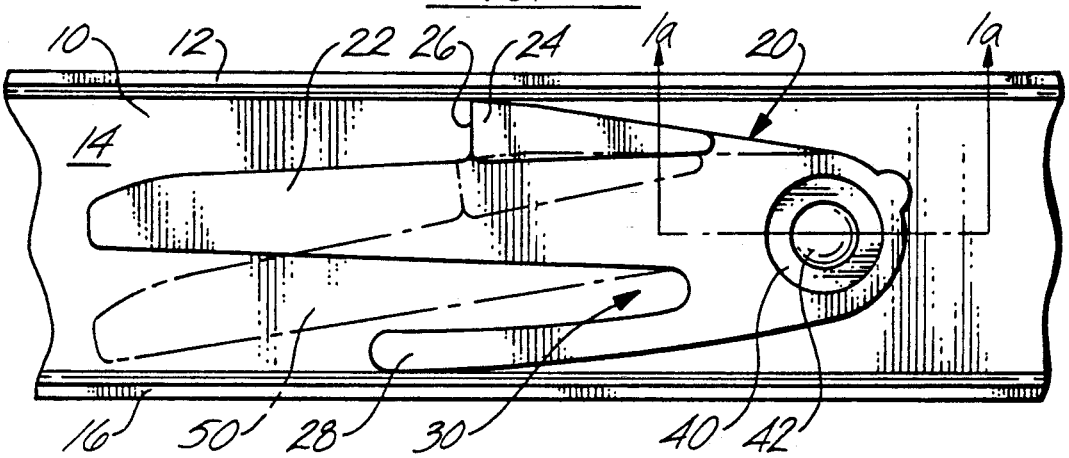
Fig. 1 PRIOR ART
FIG. 1 is an elevation view of a prior art pivoting style disconnect latch fitted to a drawer slide member with a depressed position of the lever in phantom.
Figure 1A:
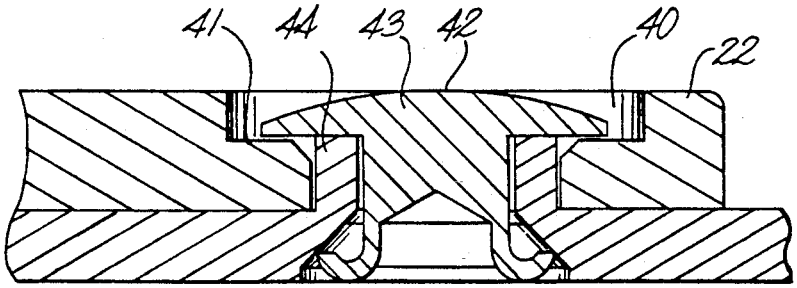
Fig. 1a PRIOR ART
FIG. 1*a* shows a side cross-sectional view of the counterbored ring taken on line 1*a*—1*a* of FIG. 1.
Figure 2:
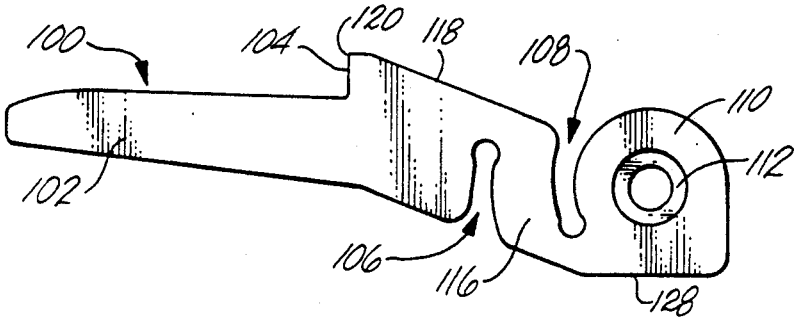
FIG. 2 is an elevation view of the invention.
Figure 3:
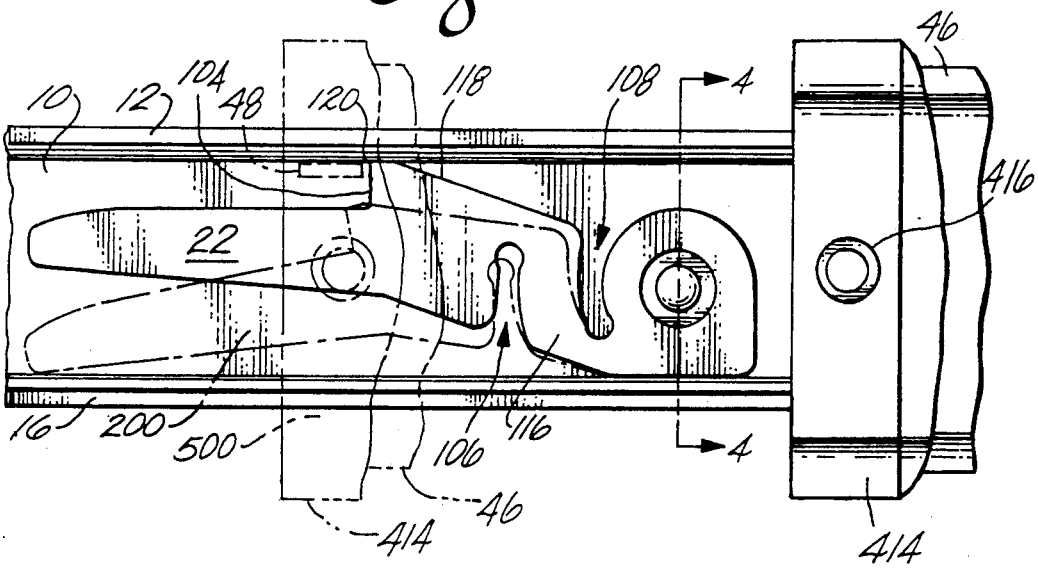
FIG. 3 is an elevation view of a latch of the invention fitted to drawer slide retainers in side view, with a flexed position of the lever and a stopped position of the slide shown in phantom.

In this position, the latch is locked so that the wall 104 limits the travel of longitudinal slide member 14 as shown in FIG. 3 by the phantom position 500 of the second member 414. The second member 414 and guide block 46 comprise a recess 416 for a rivet (not shown) to firmly secure the second channel to the guide block. The guide block 46 comprises a stopping post 48 which prevents unintentional disconnection of slide member 14. When the disconnect latch 100 is in its locked position, a wall 104 of the latch 100 will contact and stop against post 48 when the drawer is opened. Thus, the stopping post 48 blocks the movement path of the disconnect latch and the slide member 14 to which the latch is attached. However, as discussed below, when the disconnect latch is flexed downward, the wall 104 will clear the post 48 and enable the slide member 14 to move past the guide block 46. Such a slide position is shown in FIG. 6 and by the solid-line placement of the second member 414 in FIG. 3. As viewed in cross section in FIG. 6, in this position the latch is past the stopping post 46*b* with angled wall 118*b* visible behind the post.

A longitudinal channel member 14 of the slide can be removed by depressing the lever 22 towards the retainer 16. Then the lever 22 flexes counterclockwise. When the disconnect latch is depressed by finger pressure to position 200, as shown in phantom in FIG. 3, only the bottom slide retainer 16 touches the disconnect latch lever 22. Edge 128 of the ring presses against the retainer 16 and provides leverage for pushing the lever 22 down. Wall 104 will then clear post 48 to enable removal of the slide member 14.

Preferably the disconnect latch 100 is secured to the longitudinal channel 14 using a fastener 114, such as a rivet or an integrally formed annular, extruded post which secures the latch in an annular recess 112. FIG. 4 shows a sectional view of the recess 112 holding the rivet 114. The recess embraces the rivet so that the disconnect latch is attached to the longitudinal channel by the rivet passing through the latch and a matching hole 122 in the channel.

Reduced noise impact is promoted by at least one vertical slot 106, 108 provided along the longitudinal axis of the slide member. Each slot 106 and 108 is generally vertical and preferably formed with arcuate terminal ends. The slots are shaped similar to a keyhole, so that preferably the mouth of each slot is wider than the curved terminal. The slot 108 has its curved terminal closer to the retainer 16, while slot 106 has its curved terminal closer to the retainer 12. The slots preferably have an opposed orientation and the slot 108 is longitudinally proximal, while the slot 106 is longitudinally distal, in relation to the rivet 114. The slots thus are spaced apart with a bridge portion 116 interposed between the slots.

The bridge 116 is surrounded on either side by the slots. The bridge is formed unitarily with the ring 110 and the downwardly sloping wall 118. When the lever 22 is depressed, the proximal edge 124 of the bridge 116 adjacent to the slot 108 moves counterclockwise which laterally widens the slot 108. The distal edge 126 of the bridge adjacent to slot 106 also moves counterclockwise which laterally compresses the slot 106. Thus there is enough space provided for the slide member to clear the normally abutting face of the wall 104.

The use of at least one vertical slot results in the absorption of the shock energy created by the contact of the wall 104 with the longitudinal channel. Under impact load in the horizontal direction 300 as shown in FIG. 5, the proximal edge 124 of the bridge 116 adjacent to the slot 108 moves horizontally which laterally narrows the slot 108. The distal edge 126 of the bridge adjacent to slot 106 also moves horizontal which laterally compresses the slot 106.

Also, when the lever 22 is depressed, the first vertical slot 108 laterally expands while the second vertical slot 106 laterally compresses.

The downwardly sloping wall 118 also moves counterclockwise when the lever 22 is depressed. After the counterclockwise movement, the downwardly sloping wall 118 reduces the angle of its slope, so that it is almost in a horizontal position, as shown in FIG. 3. The disconnect latch thus assumes the depressed lever position 200 of FIG. 3. The flexing of the vertical slots 106 and 108 eliminates the need for the ring 110 to pivot about the rivet 114. Instead, the latch is preferably made of nylon or other suitable hard, resilient material, so that spring resilience of the latch causes the latch to return to its original position. Thus the disconnect latch 100 is more reliable in returning the lever 22 to its non-impacted position. Also the flexing method eliminates the need for precise parameters on the recess depth and diameter, extruded post height, and rivet clinch, so manufacturing costs and complexity are lessened.

The invention can be practiced in many different embodiments and variations. For example, the number of slots can vary and still ensure flexing of the latch. Although the slots must be vertical, they can be positioned in numerous locations along the longitudinal axis of the longitudinal channel. The slots can be constructed in various shapes; it is not necessary to employ a keyhole shape or rounded head. For example, a slot could have a triangular shape. Thus, the invention can be adapted to various sized slide assemblies and can interface with variously shaped slide members. All changes which come within the meaning and range of equivalency of the claims are intended to be incorporated within the scope of this invention. The present embodiments of this invention should be considered in all respects as illustrative and not restrictive; the scope of the invention to be indicated by the appended claims rather than the foregoing description.

What is claimed is:

1. A disconnect latch for a slide assembly, the slide assembly including at least one elongated channel, the disconnect latch comprising the unitarily formed combination of:

means for locking and preventing unintentional disconnection of the channel; and means for flexing the disconnect latch to clear the locking means such that the channel is released and for absorbing shock energy produced when the channel is stopped against the locking means.

2. The disconnect latch of claim 1 further including mounting means comprising a recess in the disconnect latch and channel and a fastener in the recess securing the channel to the disconnect latch.

3. The disconnect latch of claim 1 wherein the means for locking comprises a wall generally normal to the slide for blocking movement of a post on the channel.

4. The disconnect latch of claim 1 wherein the flexing means comprises at least one generally vertical slot.

5. The disconnect latch of claim 4 wherein the generally vertical slot is laterally compressible.

6. The disconnect latch of claim 4 wherein the generally vertical slot is laterally expandable.

7. The disconnect latch of claim 1 wherein the flexing means comprises two opposed, generally vertical spaced-apart slots.

8. The disconnect latch of claim 7 wherein the two generally vertical slots are spaced apart and in opposing directions, one of the slots facing upwardly and one facing downwardly.

9. The disconnect latch of claim 8 wherein the slot facing upwardly is expandable and the slot facing downwardly is compressible for the disconnect latch to clear the locking means and wherein the slot facing upwardly and the slot facing downwardly are compressible for absorbing shock energy.

10. A slide assembly comprising:

at least one elongated slide member with a rail; and a disconnect latch comprising (a) means for vertically flexing the disconnect latch such that the elongated slide member can be disengaged without pivoting the disconnect latch and (b) means for attaching the disconnect latch to the rail.

11. The slide assembly of claim 10 wherein the mounting means comprises a recess in the disconnect latch and slide member, and a rivet in the recess securing the latch to the slide member.

12. The slide assembly of claim 10 wherein the disconnect latch comprises the integrally formed combination of a downwardly moveable lever, a downwardly sloping wall rear of the lever, and a ring in a rear portion of the lever.

13. The slide assembly of claim 10 wherein the flexing means comprises at least one generally vertical slot in the latch, the slot being compressible to provide space for the slide member to clear a post on the slide member.

14. The slide assembly of claim 13 wherein the generally vertical slot is normal to a longitudinal axis of the downwardly sloping wall.

15. The slide assembly of claim 10 comprising first and second slide members, wherein the flexing means of the latch comprises two generally vertical slots in the latch, each having a mouth and a terminal.

16. The slide assembly of claim 15 wherein the two generally vertical slots are spaced-apart along a longitudinal axis of the downwardly sloping wall, and where the mouth of the slot is wider than the terminal.

17. The slide assembly of claim 15 wherein the two generally vertical slots are spaced apart and wherein one slot is upwardly facing and one slot is downwardly facing.

18. The slide assembly of claim 10 wherein the flexing means comprises a plurality of spaced-apart slots.

* * * * *